US005586602A

United States Patent [19]

Vagin

[11] Patent Number: 5,586,602

[45] Date of Patent: Dec. 24, 1996

[54] METHOD AND APPARATUS FOR SHOCK WAVE STIMULATION OF AN OIL-BEARING FORMATION

[75] Inventor: Vladimir P. Vagin, Moscow, Russian Federation

[73] Assignee: Nefteotdacha, Ltd., Moscow, Russian Federation

[21] Appl. No.: 555,421

[22] Filed: Nov. 9, 1995

[30] Foreign Application Priority Data

Apr. 11, 1995 [RU] Russian Federation ..... 95104938

[51] Int. Cl.[6] ..... E21B 43/25

[52] U.S. Cl. ..... 166/249; 166/177.1; 166/177.2

[58] Field of Search ..... 166/249, 177.1, 166/177.2, 177.6, 177.7, 177.5

[56] References Cited

FOREIGN PATENT DOCUMENTS 2001254 10/1993 Russian Federation .
1710709 2/1992 U.S.S.R. .

OTHER PUBLICATIONS

Beresnev & Johnson, "Elastic Wave Stimulation of Oil Production: A Review of Methods and Results", Geophysics vol. 59, No. 6 (Jun. 1994) pp. 1000–1017.

*Primary Examiner*—Hoang C. Dang
*Attorney, Agent, or Firm*—Steptoe & Johnson LLP

[57] ABSTRACT

Disclosed is a method and apparatus for increasing the effectiveness of shock wave stimulation of oil-bearing formations by increasing the intensity of elastic oscillations in the oil accumulation. The device includes a pumping unit and a tubing string run in the production casing of the well, hung in a wellhead. A cylinder is installed on the end of the tubing string. A plunger works in the cylinder, traveling coaxially and coming out of the cylinder at the top of the pumping unit upstroke. The plunger is connected to the pumping unit by sucker rods and a polish rod. On the plunger upstroke the fluid in the tubing string is compressed. At the top of the pumping unit upstroke the fluid in the production tubing is discharged into the production casing generating a shock wave.

14 Claims, 4 Drawing Sheets

METHOD AND APPARATUS FOR SHOCK WAVE STIMULATION OF AN OIL-BEARING FORMATION

FIELD OF THE INVENTION

The invention relates to the oil industry and can be used to increase oil recovery from an oil-bearing formation in the course of its exploitation using any known method.

BACKGROUND OF THE INVENTION

Seismic or elastic wave stimulation is a known technique for enhancing oil recovery from an oil-bearing bed, as described in "Elastic-Wave Stimulation of Oil Production: A Review of Methods and Results," *Geophysics* Vol. 59, No. 6 (June 1994). One method of generating seismic stimulation is shown in Russian Federation Patent No. 2,001,254, in which two rotating imbalanced weights cause vibration of a platform on the surface. The weight, energy and resonance frequency of the vibration generator are calculated in accordance with the physical and mechanical properties of the ground above the oil bed, and harmonic waves are induced and propagated to the oil bearing level. The main disadvantage of this method is its low efficiency; loss of energy during wave passage from the surface to the oil bed may be as high as 98% and more.

Another known method is shown in Russian Federation Patent No. 1,710,709, in which an anvil plate is dropped to the bottom of the well and a heavy weight (water-filled tubing) is repeatedly lifted and dropped onto the anvil plate, imparting vibrations into the oil bed. Although this method avoids the energy loss associated with vibration generated at the surface, it is inefficient because the force of the falling weight is directed vertically, thus limiting the energy of the elastic vibrations imparted lateral to the well. Additionally, the repeated striking of the well bottom eventually destroys that surface.

The object of the present invention is to increase the effectiveness of the wave generation wells by increasing intensity of the elastic oscillations in the oil-bearing formation and optimization of their number. Another objective of the invention is to reduce additional expenditures for setting and drilling out of cement bridges in wave generation wells and to minimize the cost of installing and maintaining the equipment required for wave stimulation of oil-bearing formations.

SUMMARY OF THE INVENTION

The posed objectives are achieved by a method of wave stimulation of the oil accumulation, involving the generation of elastic oscillations in the producing formation by inflicting periodic impacts on the bottom of the wave generation well with a force not to exceed the maximum value for elastic deformation of the hard cement behind the casing. Shocks to the bottom hole zone in response wells are delivered by waves with a pressure drop at the wave front corresponding to the compression limiting strength of the perforated zone capped with a cement plug in the wave generation wells. The shock wave is generated by means of compression and subsequent release of fluid in the wave generating wells.

The number of wave generating wells is calculated by dividing the surface area of the whole oil accumulation by the effective area for one well. Candidates for wave generating wells are depleted or newly drilled artificial lift wells equipped with pumping jacks and wells which are recompleted from a lower horizon to an upper one. In the case of wells to be recompleted from a lower horizon to an upper one, a cement plug is installed at or below the base of the upper producing interval. Newly drilled wells are left unperforated during service as wave generation wells.

The device for wave stimulation of the oil accumulation includes a lifting mechanism in the form of a pumping unit installed at the wellhead and a tubing string suspended in the production casing of the well having a cylinder and seating ring installed on the bottom end of the tubing string. A plunger connected to the pumping unit by means of sucker rods and a polish rod is installed in the cylinder so that the plunger exits from the cylinder at the top of the upstroke. One or more centralizers are installed in the tubing string above the cylinder.

In operation, the well casing and tubing string are filled with a liquid such as water and sealed tight. The motion of the pumping unit causes the plunger to move up and down in the cylinder at the end of the tubing string. On the upstroke, the liquid in the tubing string above the plunger is compressed, while the liquid below the plunger is subject to negative pressure. At the top of the stroke, the plunger is pulled out of the cylinder, suddenly releasing the compressed liquid and causing a compression shock wave to travel downward until it strikes the floor of the well. On the downstroke, the plunger is reinserted into the cylinder.

DETAILED DESCRIPTION OF THE INVENTION

Figure 1:
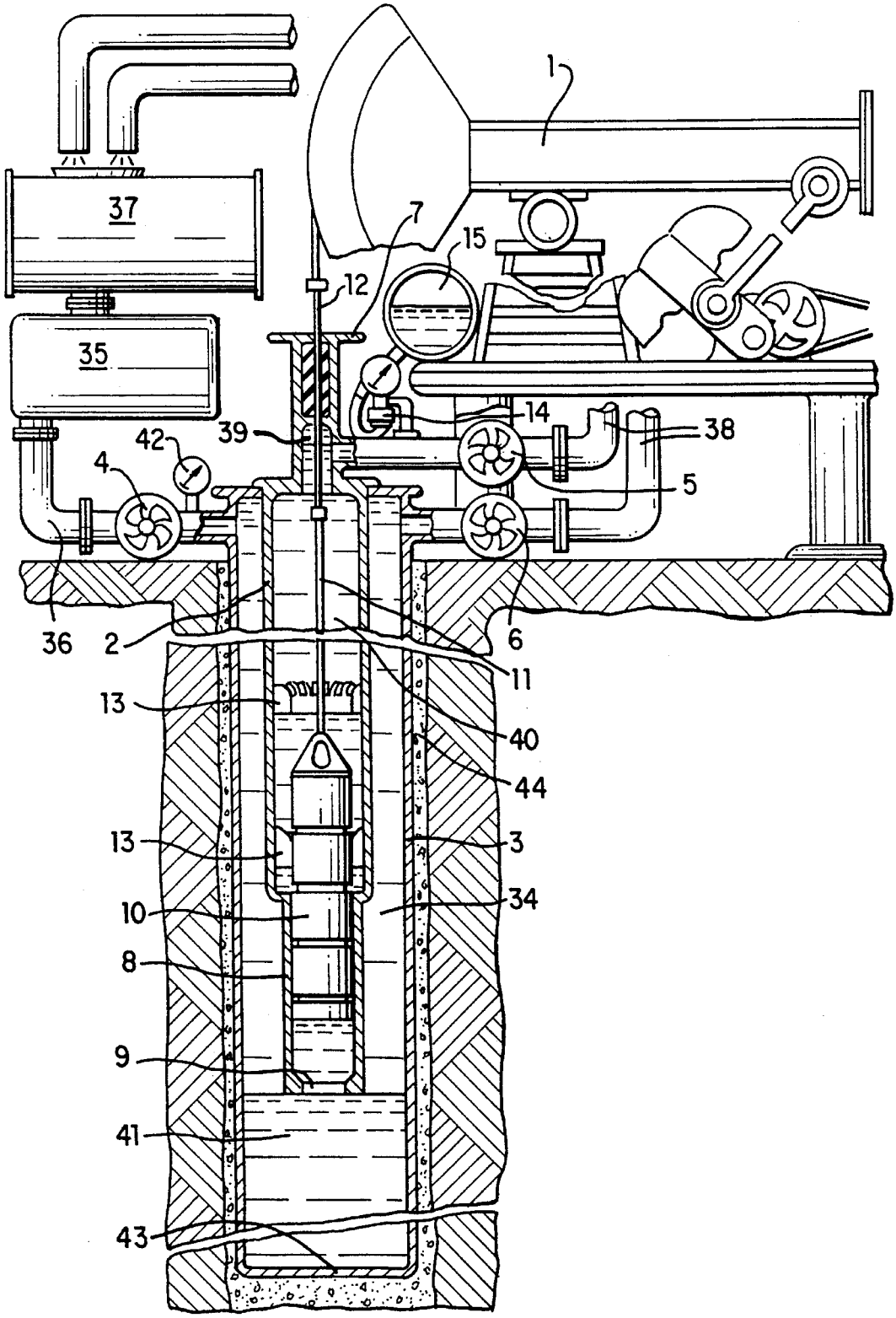
FIG. 1 shows the general view of the device installed on the well.

As seen in FIG. 1, the pressure wave generating device includes a lifting mechanism in the form of a pumping unit 1, a tubing string 2 run into the production casing 3 of the well, suspended in the wellhead from the Christmas tree consisting of casing valve 4, tubing valve 5, bypass valve 6, and stuffing box 7. A cylinder 8 with a seating ring 9 is installed at the end of tubing string 2. Plunger 10 is run in cylinder 8 to allow for axial displacement and withdrawal from cylinder 8 at the top of the upstroke of the pumping unit 1. Plunger 10 is connected to pumping unit 1 via sucker rods 11 and polish rod 12. One or more centralizers 13 are installed in the lower portion of tubing string 2 to keep plunger 10 aligned with cylinder 8 when it is withdrawn from cylinder 8.

Figure 2:
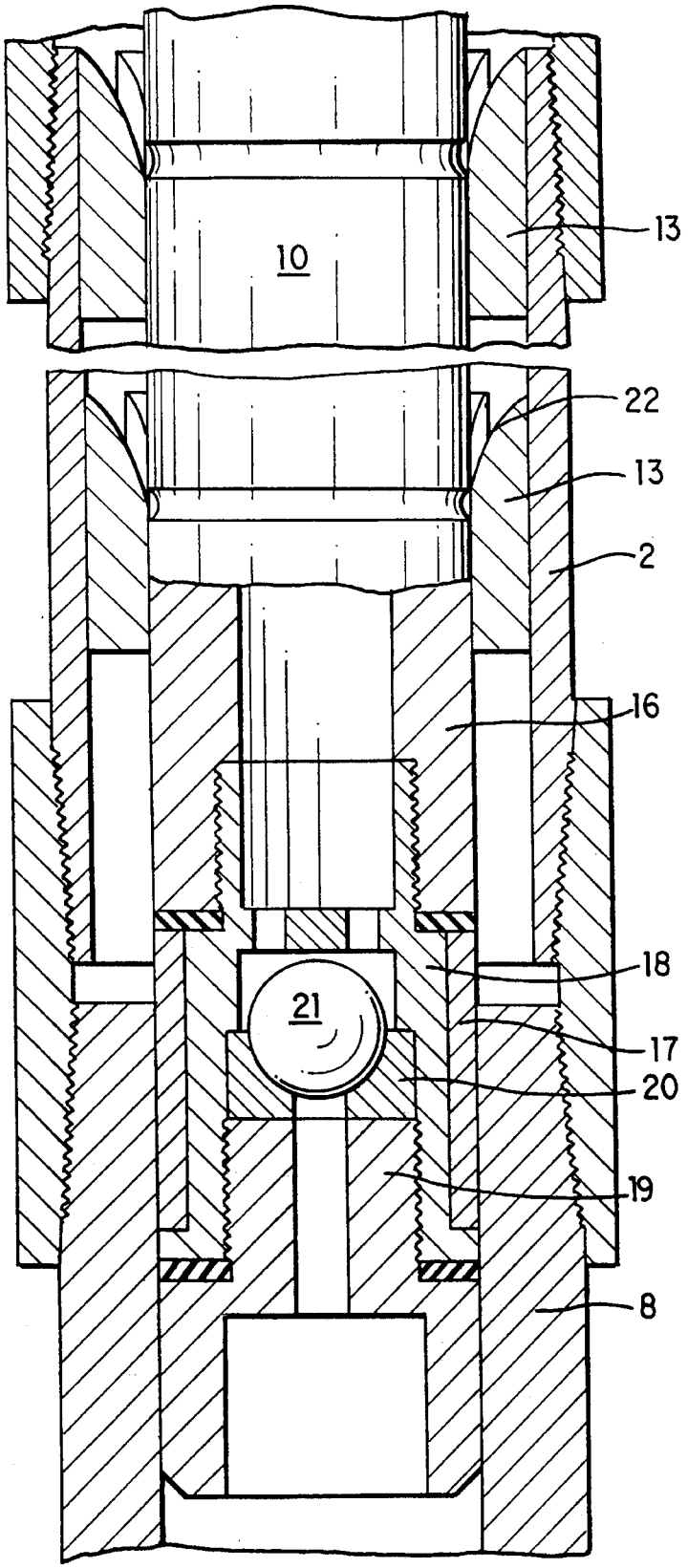
FIG. 2 shows a cross-section along the lower portion of the plunger, upper portion of the cylinder, and the centralizer.
Figure 4:
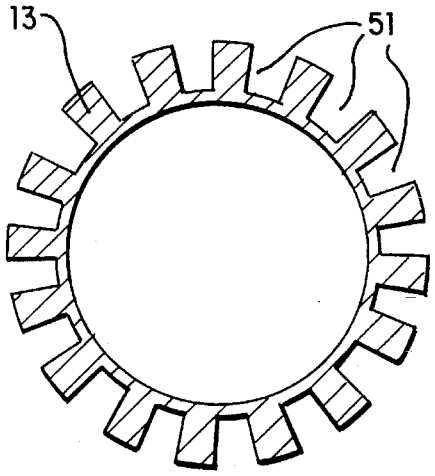
FIG. 4 shows a cross-section of the centralizer bushing.

Plunger 10 (FIG. 2) is constructed in the form of a flow-through cylinder 16, in the lower part of which, bushing 17 and two threaded retainers 18 and 19 are installed coaxially. Between threaded retainers 18 and 19 are located the seating ring 20 and sealing ball 21. Centralizer 13 is made in the form of bushings with a conical taper 22 and flow channels 51 (FIG. 4) fixed in the production tubing 2.

The supply device 14, (FIG. 3), is made in the form of a housing 23 having a chamber 24. Housing 23 is attached to a pressure gauge 25, gauge line bleed valve 26, pressure tube 27, pressure tube bleed valve 28, and a supply hose 29. The pressure tube 27 is coupled to the wellhead 30, while the supply hose 29 is connected to chamber 15. Inside chamber 24, sealing ring 32 with sealing ball 33 are installed on threaded retainer 31 so as to separate the pressure tube 27 and supply hose 29.

Operating the device is achieved in the following manner. Into each well selected for wave generation, the described device is mounted and the well is filled with fluid 34 (FIG. 1). In most cases, water is the selected fluid. To perform this operation, a pump 35 is connected with an elbow 36 to the flange of casing valve 4, while surge chamber 37 is connected by elbows 38 to the flanges of production valve 5 and bypass valve 6. Opening valves 4, 5 and 6, fluid 34 is pumped into the well by means of pump 35 until stable circulation is achieved, filling the well and the device with fluid 34.

Figure 3:
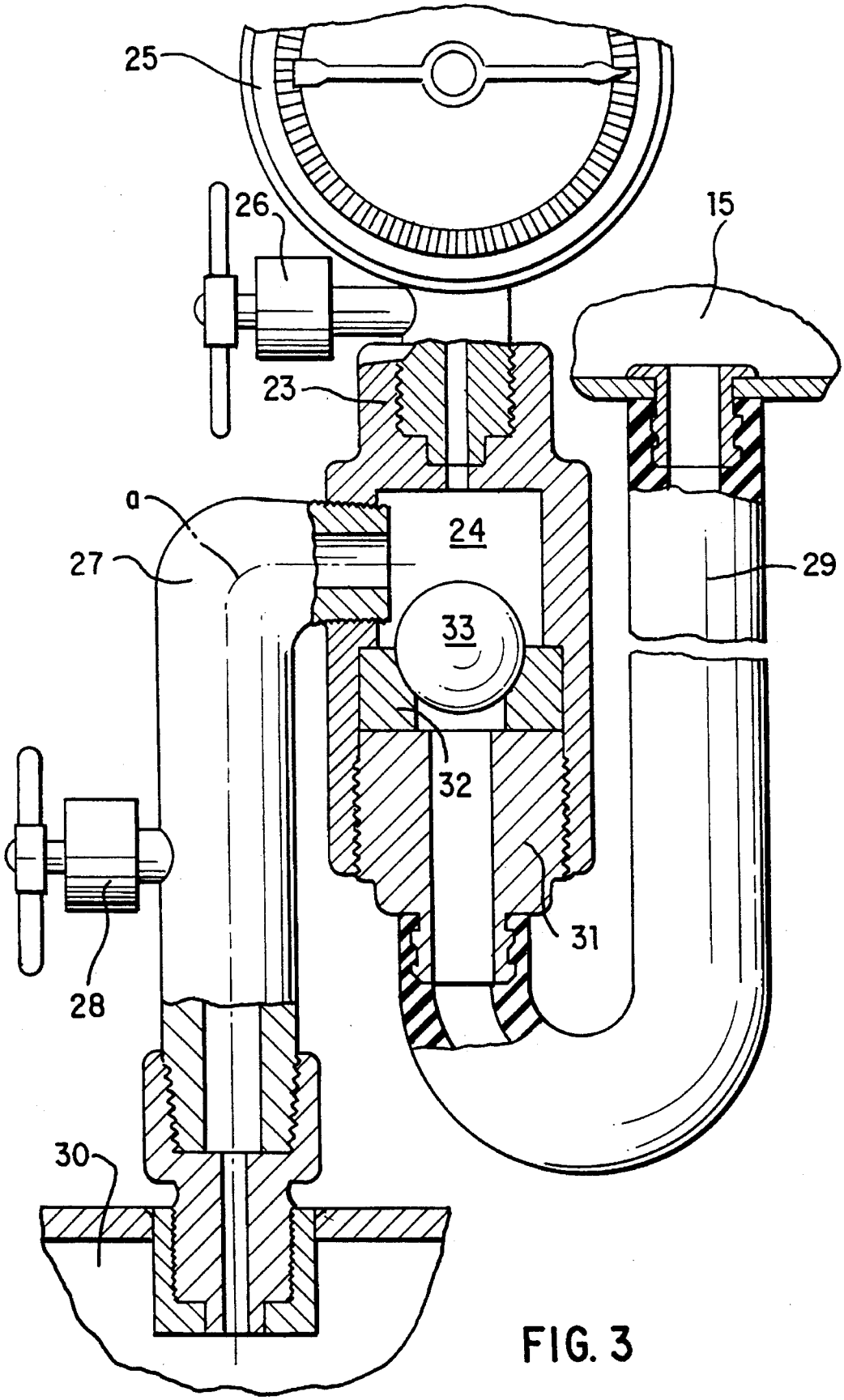
FIG. 3 shows a cross-section of the supply device.

In the process of stable circulation of liquid 34, chamber 15 is also filled. To achieve this, the body 23 of the supply device 14 is turned 180° with respect to axis "a" (FIG. 3). In the process, the sealing ball 33 comes off its seat 32 and liquid 34 from the wellhead 30 enters chamber 15 through pressure tube 27 and supply hose 29. After filling chamber 15, body 23 of the supply device 14 is returned to its original position.

Valves 4, 5, 6, and bleed valve 28 are then closed, and stuffing box 7 is disconnected from the wellhead. The upper portion of the wellhead is filled with liquid 39, which has a lower density and higher viscosity than liquid 40. Liquid 39, which may be a light lubricating oil, remains at the top of the wellhead and lubricates and seals the stuffing box as the polish rod passes through it.

Stuffing box 7 is then reinstalled, valve 4 is opened and the pressure in the well is increased using pump 35 until all of the air in the liquid is dissolved to 1–2 MPa. Valve 4 is then closed and bleed valve 28 is opened. Pump 35, elbow 36, surge chamber 37, and elbow 38 are disconnected from the wellhead by closing their respective valves.

Pumping unit 1 is then turned on. As the plunger 10 moves down; liquid 34 raises sealing ball 21 and flows from below to above plunger 10. As the plunger 10 moves up, sealing ball 21 isolates liquid 40 from liquids 34 and 41. Liquids 34, 40 and 41 are all the same fluid (e.g., water) that was pumped into the device originally. As a result, compression of liquid 40 and expansion of liquids 34 and 41 occur. The degree of compression of liquid 40 is recorded on pressure gauge 25; the degree of expansion of liquids 34 and 41 is recorded on pressure gauge 42. Sealing ball 33 (FIG. 3) prevents liquid cross-flow from the wellhead 30 into chamber 15. As the pumping unit 1 approaches the uppermost position, plunger 10 pulls out of cylinder 8. At the moment that plunger 10 pulls out of cylinder 8, liquid 40 is vented into liquid 41. A compression shock wave is generated in liquid 41 and it moves along casing 3 and delivers a shock to the bottom of the well 43, then is reflected upward.

The reflected shock wave, on reaching the wellhead, once again changes its direction and delivers a repeat impact on the bottom of the well 43. Thus, the well fluid experiences a wave oscillation process with a frequency of pressure oscillations, f, numerically equal to C/2L, where C is the velocity of the shock wave front, and L is the length of production casing in the well. To increase the frequency of impacts "f" on the bottom of the well 43, a reflector (not shown) can be installed in production casing 3 to reduce the travel path "L," thereby achieving the desired objective.

Figure 5:
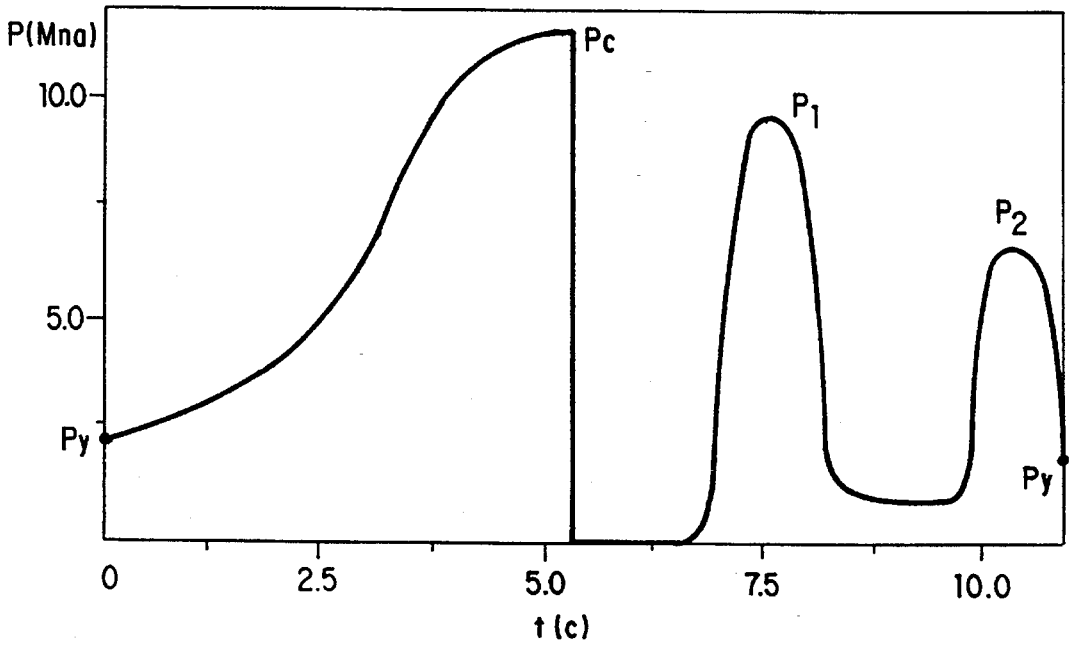
FIG. 5 shows a theoretical graph for changes in wellhead pressure in the process of operating the device.

Through one stroke of pumping unit 1 at a speed of 5 strokes per minute and well depth of the order of 2,000 meters, the wellhead pressure recorded on manometer 25 undergoes the changes shown in FIG. 5. As the plunger 10 travels upward, it gradually increases from a static pressure $P_y$ to liquid pressure $P_c$. On approaching the uppermost position of pumping unit 1 the pressure drops to below the zero point. Inasmuch as at this time there is some pressure drop between the hydrostatic liquid pressure in chamber 15 and well pressure, liquid cross-flow occurs from chamber 15 into the wellhead 30 through supply hose 29 and pressure tube 27. As plunger 10 travels downward, pressure gauge 25 registers two reflected waves. The first reflected wave returns to the wellhead with some pressure $P_1$ which is lower than pressure $P_c$. The second reflected wave returns to the wellhead with some pressure $P_2$ which is less than pressure $P_1$. At the moment when pumping unit 1 approaches the lowest point of travel, the pressure at the wellhead becomes equal to static pressure $P_y$. The described cycle of pressure changes then repeats itself.

In the process, the slug of liquid flowing from chamber 15 into the wellhead 30 in each cycle depends on the position of drain valve 28 and the height of chamber 15 at the surface. With greater leakage through stuffing box 7 and greater loss of liquid down the well, valve 28 is opened wider while chamber 15 is raised higher above the surface. With low rates of leakage through stuffing box 7 and lesser liquid losses to the well valve 28 is pinched back and chamber 15 is raised less above the surface. The required opening of valve 28 and elevation of chamber 15 above the surface are determined experimentally or by calculations based on the operating conditions for the installation with minimal static wellhead pressure $P_y$ and maximum venting pressure $P_c$. After selecting the optimum operating conditions for the device, the valve 26 is pinched back and pressure gauge 25 is shut off, since it would not withstand prolonged operation under the conditions of changing pressures described above.

In the process of operating the system, fluid is added to chamber 15 and stuffing box 7 is serviced as required. The impact force at the bottom of the well 43 will be a function of the length of the tubing string and the travel of the plunger. This force should not exceed the limiting value for the elastic deformation of cement in the casing annulus 44. The optimum operating condition for the device is achieved by setting the speed of the pumping unit to correspond to the frequency of well fluid oscillation of the reflected compression wave.

Implementing the inventive method and device for an entire oil field is achieved in the following manner. First, the effective zone for a single well in the wave generating group is determined. Toward this end, the inventive device is put in operation and the performance of surrounding wells is observed. The boundary for the effect of one wave generating well is a line passing through the bottom hole locations of the furthest wells responding to the stimulation. In the first approximation the zone effected by a single wave generating well can be estimated as a circle with a radius of 2,500 to 3,000 meters. The number of wave generating wells is determined by dividing the surface area of the entire oil accumulation by the area effected by one well, and the entire accumulation is then broken up into that number of equal zones. Within each zone a wave generating well is selected out of those being recompleted from a lower to an upper horizon, a newly drilled well or a well designed for artificial lift. To save expense, candidate wells should already be equipped or intended to be equipped with a pumping unit.

Because the compression wave works as a sealed system, there should be no perforations in the well casings; otherwise the operating fluid will be injected into the accumulation zone. In the case of using wells being recompleted from a lower to an upper interval, a cement plug is generally installed at or below the base of the upper producing interval. In the case of a well designated for artificial lift, a cement plug is installed above the perforated interval. Finally, in the case of using newly drilled wells, they are left unperforated.

Utilizing this method for wells recompleted in an upper horizon from a lower, newly drilled wells and artificial lift wells equipped or designated to be equipped with pumping units, makes it possible to eliminate additional expenditures for setting cement plugs, since plugs are installed in these wells in accord with the general plan of development, regardless of whether the wells are used for shock wave stimulation. On the other hand, setting cement plugs in wells recompleted from a lower horizon to an upper and leaving unperforated newly drilled wells serves to eliminate the additional cost for drilling up cement plugs, inasmuch as it would not be required in subsequent conversion of wells from wave generating to producing status. Finally, making use of the described device makes it possible to reduce the expenditures for its manufacture and servicing since all of the basic components can be made from standard oil field equipment.

Although the present invention has been described in considerable detail with reference to a preferred version thereof, other versions are possible. For example, operating fluids other than water may be used, and other designs for the plunger, the fill system or the lift mechanism may be employed. Therefore, the spirit and scope of the appended claims should not be limited to the description of the preferred version contained herein.

I claim:

1. A device for imparting a controlled compression shock wave to a lower portion of a well, comprising a means for injecting fluid to fill the well, means for containing the fluid in a closed system, means for compressing a portion of the fluid located in an upper part of the well, and means for suddenly releasing the compressed fluid into the lower portion of the well.

2. The device of claim 1 wherein the means for compressing fluid is comprised of a tubing string with an upper end and a lower end, attached at its upper end to a wellhead of the well; a tubular cylinder, having a smaller diameter than the tubing string, coaxially attached to the lower end of the tubing string; a plunger disposed in the cylinder and capable of being alternately withdrawn from the cylinder into the tubing string and reinserted into the cylinder; and means for withdrawing the plunger upward from the cylinder and reinserting the plunger downward into the cylinder.

3. The device of claim 2 wherein the means for withdrawing and reinserting the plunger is comprised of at least one rod connecting an upper portion of the plunger to a pumping jack.

4. The device of claim 2 wherein the plunger comprises a cylindrical housing having a top and bottom and a means for controlling passage of fluid by allowing flow of fluid through the plunger as it is moved downward and preventing the flow of fluid through the plunger as it moves upward.

5. The device of claim 4 wherein the means for controlling passage of fluid comprises a tight seal between the plunger housing and the cylinder, and a fluid passageway from the bottom of the plunger to a lower portion of a chamber having a seating ring and a sealing ball and a fluid passageway from an upper portion of the chamber to the top of the plunger, whereby during upward plunger movement the sealing ball engages the seating ring, preventing flow through the chamber and during downward plunger movement the sealing ball is lifted from the seating ring, allowing flow through the chamber.

6. The device of claim 3 further including one or more centering devices in the tubing string for aligning the plunger with the cylinder.

7. The device of claim 6 wherein the centering device comprises a bushing having a conical taper and a plurality of flow channels around its circumference.

8. The device of claim 2 wherein the means for injecting fluid to fill the well includes a pump connected to the well; a surge chamber connected to the well; and a supply device, said supply device comprising a rotatable housing connected to the well, said housing having an internal chamber, a pair of exit passageways, a seating ring and sealing ball disposed in the chamber so as to render one exit passageway sealable when the housing is rotated to cause the sealing ball to engage the seating ring; a hose connection from the sealable passageway to a supply chamber, a tubular connection from the other passageway to the well, and a pressure gauge connected to the internal chamber.

9. The device of claim 5 wherein the means for injecting fluid to fill the well includes a pump connected to the well; a surge chamber connected to the well; and a supply device, said supply device comprising a rotatable housing connected to the well, said housing having an internal chamber, a pair of exit passageways, a seating ring and sealing ball disposed in the chamber so as to render one exit passageway sealable when the housing is rotated to cause the sealing ball to engage the seating ring; a hose connection from the sealable passageway to a supply chamber, a tubular connection from the other passageway to the well, and a pressure gauge connected to the internal chamber.

10. The device of claim 5 wherein the means for withdrawing and reinserting the plunger comprises at least one rod connecting an upper portion of the plunger to a pumping jack.

11. A method for imparting periodic elastic wave stimulation to the accumulation zone of an oil field having a plurality of producing wells, comprising the steps of selecting at least one well for wave generation; sealing the wave generation well so it is capable of functioning as a closed system; filling the well with a fluid; compressing an upper portion of the fluid in the well; suddenly releasing the compressed fluid into the remaining fluid, thereby creating a compression shock wave that travels to the well bottom; and repeating the steps of compressing and releasing the fluid.

12. The method of claim 11, wherein compression and release of the fluid is accomplished by the steps of inserting a plunger into an open-ended cylinder attached below a tubing string attached to a wellhead of the fluid-filled well; pulling the plunger upward, thereby compressing the fluid in the tubing above the plunger; pulling the plunger out of the cylinder, thereby allowing the compressed fluid to enter the fluid in the cylinder suddenly and pass through to the fluid in the lower portion of the well; and re-inserting the plunger into the cylinder.

13. The method of claim 12, wherein the plunger is moved by a pumping unit attached to the plunger by one or more rods connecting the plunger to the pumping unit.

14. The method of claim 12, further including the step of ascertaining the frequency of the compression shock wave as the wave is reflected from the bottom to the top of the well and back, and moving the plunger at a rate such that new shock waves are generated at a rate that corresponds to the frequency of the reflected waves.

* * * * *